US010633615B2

(12) United States Patent
Scialla et al.

(10) Patent No.: US 10,633,615 B2
(45) Date of Patent: Apr. 28, 2020

(54) AUTOMATIC DISHWASHING CLEANING COMPOSITION

(71) Applicant: The Procter & Gamble Company, Cincinnati, OH (US)

(72) Inventors: Stefano Scialla, Strombeek-bever (BE); Glenn Steven Ward, Newcastle upon Tyne (GB); James Elliot Goodwin, Newcastle upon Tyne (GB); Yonas Gizaw, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 129 days.

(21) Appl. No.: 15/683,851

(22) Filed: Aug. 23, 2017

(65) Prior Publication Data

US 2018/0134992 A1 May 17, 2018

(30) Foreign Application Priority Data

Sep. 1, 2016 (EP) ..... 16186737
Oct. 3, 2016 (EP) ..... 16192040
May 31, 2017 (EP) ..... 17173702

(51) Int. Cl.

| | |
|---|---|
| ***C11D 3/60*** | (2006.01) |
| ***C11D 3/22*** | (2006.01) |
| ***C11D 3/37*** | (2006.01) |
| ***C11D 11/00*** | (2006.01) |
| ***A47L 15/00*** | (2006.01) |
| ***C11D 3/33*** | (2006.01) |

(52) U.S. Cl.

CPC ..... *C11D 3/227* (2013.01); *A47L 15/0007* (2013.01); *A47L 15/0065* (2013.01); *C11D 3/33* (2013.01); *C11D 3/378* (2013.01); *C11D 3/3719* (2013.01); *C11D 3/3769* (2013.01); *C11D 3/3776* (2013.01); *C11D 3/3788* (2013.01); *C11D 3/3796* (2013.01); *C11D 11/0035* (2013.01)

(58) Field of Classification Search

CPC ..... C11D 3/3769
USPC ..... 510/220
See application file for complete search history.

(56) References Cited

U.S. PATENT DOCUMENTS

| | | | | |
|---|---|---|---|---|
| 4,368,146 | A | 1/1983 | Aronson | |
| 5,981,456 | A | 11/1999 | Tartakovsky | |
| 6,326,343 | B1 | 12/2001 | Ghatlia et al. | |
| 6,632,785 | B2 | 10/2003 | Pfeiffer | |
| 6,718,992 | B1 | 4/2004 | Cardola et al. | |
| 6,827,795 | B1 * | 12/2004 | Kasturi | A61K 8/44 134/39 |
| 6,903,064 | B1 * | 6/2005 | Kasturi | C11D 3/0026 424/70.11 |
| 7,923,428 | B2 | 4/2011 | Geffroy | |
| 8,044,012 | B2 | 10/2011 | Yoshikawa | |
| 8,354,368 | B2 | 1/2013 | Schunicht | |
| 8,680,038 | B2 | 3/2014 | Balastre et al. | |
| 9,752,100 | B2 | 9/2017 | Warkotsch | |
| 10,047,323 | B2 | 8/2018 | Letzelter et al. | |
| 2009/0048143 | A1 | 2/2009 | Iverson | |
| 2010/0139705 | A1 | 6/2010 | Oberlander | |
| 2011/0028371 | A1 * | 2/2011 | Rodrigues | C08F 2/38 510/220 |
| 2011/0137001 | A1 | 6/2011 | Prat | |
| 2012/0128608 | A1 * | 5/2012 | Rodrigues | C02F 5/10 424/59 |
| 2013/0274170 | A1 * | 10/2013 | Yuan-Huffman | A61Q 19/00 510/337 |
| 2017/0145352 | A1 | 5/2017 | Turk et al. | |

FOREIGN PATENT DOCUMENTS

| | | |
|---|---|---|
| EP | 0560519 A2 | 9/1993 |
| FR | 2796390 A1 | 1/2001 |

OTHER PUBLICATIONS

International Search Report; International Application No. PCT/US2017/048112; dated Dec. 21, 2017; 15 pages.

* cited by examiner

*Primary Examiner* — Gregory E Webb
(74) *Attorney, Agent, or Firm* — Abbey A. Lopez

(57) ABSTRACT

An automatic dishwashing cleaning composition including a dispersant polymer and a surface-modification surface-substantive polymer.

15 Claims, No Drawings

AUTOMATIC DISHWASHING CLEANING COMPOSITION

FIELD OF THE INVENTION

The present invention relates to a cleaning composition, in particular an automatic dishwashing cleaning composition comprising a dispersant polymer and a surface-modification surface-substantive polymer. The composition is good for prevention of spotting and provides good shine.

BACKGROUND OF THE INVENTION

The role of a dishwashing composition is twofold: to clean soiled dishware and to leave it shiny. Typically when water dries from surfaces water-marks, smears and/or spots are left behind. These water-marks may be due to the evaporation of water from the surface leaving behind deposits of minerals which were present as dissolved solids in the water, for example calcium, magnesium and sodium ions and salts thereof or may be deposits of water-carried soils, or even remnants from the cleaning product. During the course of this work, it has been observed that this problem can be exacerbated by some cleaning compositions which modify the surface of the dishware during the automatic dishwashing process such that after rinsing, discrete droplets or beads of water remain on the surface instead of draining off. These droplets or beads dry to leave noticeable spots or marks known as water-marks. This problem is particularly apparent on ceramic, stainless steel, plastic, glass and painted surfaces.

The object of the present invention is to provide a dishwashing composition that leaves the washed dishware shiny and with reduced incidence or free of spots.

SUMMARY OF THE INVENTION

According to the first aspect of the invention, there is provided an automatic dishwashing cleaning composition. The composition comprises a combination of two polymers: a dispersant polymer and a surface-modification surface-substantive polymer.

The cleaning composition of the invention modifies the surface of the washed dishware. In the case of glass, after the glass have been washed with the composition of the invention, the contact angle with deionized water, measured after a dishwashing cycle in the presence of soil is less than about 50°, preferably less than about 48°. Preferably, the contact angle is greater than 5°.

The surface-modification surface-substantive polymer modifies surfaces, such as glass such that water sheets and drains uniformly without leaving marks behind. This reduces or avoids spots formation and contributes to good shine of the dishware.

The combination of the two polymers in the composition of the invention provides good cleaning and prevention of spot formation, thereby resulting in shiny dishware.

The dispersant polymer is a sulfonated polymer and the surface-modification surface-substantive polymer is selected from the group consisting of:

i) a quaternized ammonium acrylamide acrylic acid copolymer;

ii) a polymer of modified corn starch with acrylic acid and acrylamidopropyltrimethylammonium chloride iii) a polymer formed from ethanaminium, N,N,N-trimethyl-2-[(2-methyl-1-oxo-2-propen-1-yl)oxy]-, chloride, 2-propenamide and 2-propenoic acid;

iv) a polymer comprising a monomer that carries a chemical functionality selected from the group consisting of betaines and sulfobetaines;

v) a polymer having the following formula

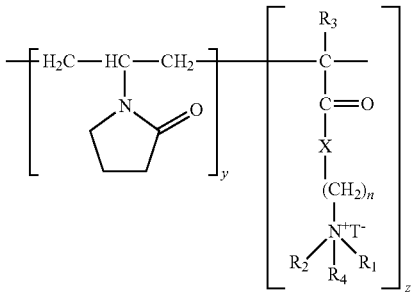

wherein $R_1$, $R_2$, $R_3$, $R_4$ are independently selected from H or $CH_3$ and not all can be H at the same time, when $R_1$ is H, $R_2$ and $R_4$ are $CH_3$ when $R_2$ is H, $R_1$ and $R_4$ are $CH_3$ when $R_4$ is H, $R_2$, and $R_1$ are $CH_3$ X is —O— or —NH—

T=Cl; Br; I; hydrogensulfate or methosulfate; ethylsulfate n=2-6 and the molecular weight of the polymer is from 60,000 to 1,500,000 dalton; and vi) mixtures thereof.

According to the second aspect of the invention, there is provided a method of dishwashing, using the composition of the invention. Glassware cleaned according to the method of the invention is left with a reduced number of spots and very shiny.

According to the last aspect of the invention, there is provided the use of the composition of the invention to reduce spotting in automatic dishwashing.

The elements of the composition of the invention described in connection with the first aspect of the invention apply mutatis mutandis to the second and third aspects of the invention.

DETAILED DESCRIPTION OF THE INVENTION

The present invention encompasses an automatic dishwashing cleaning composition, comprising a dispersant polymer and a surface-modification surface-substantive polymer. The composition greatly reduces spotting and provides excellent cleaning and shine, in particular on glassware. The composition also provides benefits on metalware, such as stainless steel. The invention also encompasses a method of automatic dishwashing, using the composition and the use of the composition to reduce spotting in automatic dishwashing, in particular on glassware.

For the purpose of this invention "dishware" encompasses tableware, cookware and any food-holding/handling items used for meal preparation, cooking and/or eating. Dishware is usually made of ceramic, stainless steel, plastic or glass.

Deionized Water Contact Angle Measurement Test Method

The contact angle of deionized water on glasses washed in a dishwasher with the automatic dishwashing composition of the invention in the presence of soil is measured in accordance with the following protocol.

Four new tumbler-style drinking glasses (such as Libbey® part number 158LIB Heavy Base 20 Oz. Ice Tea Glass Tumbler, from Libbey Inc, Toledo, Ohio, U.S.A.) are conditioned by washing them with a phosphate-free automatic dishwashing cleaning composition, (such as the dishwashing cleaning composition specified herein as Composition E and F of Example 2), and then washing the glasses again with 20 g of food-grade citric acid powder. Both washes are carried out using a Miele GSL dishwashing machine (Miele Co. Ltd, Oxon, U.K.) or equivalent, in a normal wash 50° C. program, with soft water (3 US gpg).

After being conditioned as described herein before, the glasses are washed with the composition of the invention by placing the four glasses on the top rack of the dishwasher, and placing two plastic pots containing 50 g of ATS frozen soil (as detailed herein below) into a Miele GSL dishwashing machine (Miele Co. Ltd, Oxon, U.K) or equivalent, at the start of the main wash, at the same time as the cleaning composition. A normal wash 50° C. program is carried out with hard water (20 US gpg). The glasses are removed at the end of the full wash cycle and the contact angle of deionized water is measured promptly and with great care taken to prevent contamination of the outer surface of the glass.

The contact angle measurements are conducted using a Krüss MobileDrop instrument (such as the MobileDrop model GH11, from Krüss GmbH, Hamburg, Germany), and the accompanying software (such as the Drop Shape Analysis 2 software). The measurements are run using deionized water at 20° C. Six measurements are made on the outside of each individual glass, with the six drops being distributed evenly around the circumference of the glass. Both sides of each drop's image is measured and averaged, and the total average value measured for all drops is reported.

The ATS frozen soil composition is prepared using the following ingredients and preparation instructions:

| Soil ingredient | Weight | Tolerance |
|---|---|---|
| Potato Starch—(such as Tipiak (Fecule)) | 136 g | ±0.5 g |
| Wheat Flour—(such as Rochambeau (Farine de ble)) | 109.5 g | ±0.5 g |
| Vegetable oil—(such as Asda) | 108 g | ±0.5 g |
| Margarine—(such as Stork) | 108 g | ±0.5 g |
| Lard—(such as Asda) | 108 g | ±0.5 g |
| Single Cream | 219 g | ±0.5 g |
| Baking Spread—(such as Asda Best for Baking) | 108 g | ±0.5 g |
| Contents of Large Chicken Eggs | 219 g | ±0.5 g |
| Whole Milk—(such as Asda Own) | 219 g | ±0.5 g |
| Ketchup—(such as Heinz) | 75 g | ±0.5 g |
| Mustard—Amora, (such as Moutarde de Dijon) | 100 g | ±0.5 g |
| Benzoic—(such as ex Fluka or equivalent) | 18.5 g | ±0.2 g |
| Hard Water (20 US gpg) | 918 g | ±1 g |
| Total | 2446 g | |

Soil Preparation:

1. Weigh out the appropriate amounts of each ingredient as detailed above.
2. Add water to the potato starch, heat in a pan until a gel is formed. Leave the pan to cool at room temperature overnight.
3. Add the Ketchup and mustard to a bowl and mix vigorously using food blender (such as a Blixer Coupe 5VV at Speed 6)) until fully combined, approximately 1 minute.
4. Melt Margarine (1 min), lard (2 min) and baking spread (1 min) individually in a microwave (full power 750 W) and allow to cool to room temperature (15 mins) then mix together vigorously.
5. Add Wheat Flour and Benzoic acid to a bowl and mix vigorously.
6. Break approximately 6 large eggs into a bowl and mix the egg contents vigorously (1 min).
7. Weigh out 219 g of the egg contents into a bowl. Add 219 g vegetable oil to the eggs and stir using a hand blender (1 min)
8. Mix the cream and milk in a bowl (1 min)
9. Add all of the ingredients together into a large container and mix vigorously for 10 mins using the food blender (such as Blixer Coupe 5VV at Speed 6)
10. Weigh out 50 g batches of this mixture into plastic pots and freeze at approximately −18° C.

Surface-Modification Surface-Substantive Polymer

The cleaning composition of the invention preferably comprises from about 0.01% to 10%, more preferably from 0.05% to 8%, especially from 0.1% to 5%, by weight of the cleaning composition, of the surface-modification surface-substantive polymer.

The surface-modification surface-substantive polymer of the composition of the invention provides a very characteristic water drainage profile off glass. When a glass has been treated with an aqueous composition comprising the polymer and it is then rinsed with water, the water runs off by sheeting.

Surface-Modification Surface-Substantive (SMSS) Polymer Test Method.

In order to assess whether a polymer is a surface-modification surface-substantive (SMSS) polymer within the meaning of the invention, the following test is conducted: A conditioned drinking glass (washed in an automatic dishwasher in soft water at 50° C. with a phosphate-free cleaning composition, and then washed again with 20 g of food-grade citric acid powder, as detailed herein in the contact angle measurement test method instructions section), is immersed in a solution comprising 0.5 g of test polymer in 5 L of deionized water for 20 mins. The wet glass is then placed inverted (i.e., upside down) on a support rack and rinsed with dyed water. The dyed water is comprised of 6000 mL of deionized water dyed with 8 mL of sanolin blue liquid dye EHRL (Clariant International Ltd, Muttenz, Switzerland). 100 mL of dyed water is squirted onto the outside wall of the inverted glass with a syringe having an outlet of 2 mm diameter. The flow behaviour of the dyed water is visually observed. The test polymer is considered to be a surface-modification surface-substantive polymer if the dyed water is observed to sheet uniformly.

Without wishing to be bound by theory, it is believed that the surface-modification surface-substantive polymer works by facilitating efficient drainage of the wash liquor and/or rinsing water by forming uniform sheets. This helps prevent the generation of aqueous droplets which, upon drying, can result in deposition of residues on the dishware surface and consequent formation of visible spots or streaks. The surface-modification surface-substantive polymer has sufficient surface substantivity to remain on the surface of the dishware during the rinse cycles, thus providing the drainage action in the rinse phase even if the surface-modification surface-substantive polymer has been delivered into the main wash solution, together with the rest of the cleaning composition. This reduces or eliminates the need for a separate rinse aid product. The composition of the invention provides benefits on glass, ceramics, plastics and stainless steel dishware.

Preferably, the surface-modification surface-substantive polymer is cationic. By "cationic" polymer is herein meant a polymer having a net positive charge under the conditions of use. The polymer can have anionic monomers but the net charge when the polymer is used in the composition of the invention in a dishwashing operation is cationic. The cationic nature of the surface-modification surface-substantive polymer contributes to its affinity for negatively charged surfaces such as glass, ceramic and stainless steel.

Polymers with zwitterionic groups, i.e. groups comprising anionic and cationic units are also useful in the composition of the invention.

The surface-modification surface-substantive polymer can render glass surfaces hydrophilic. When a glass surface is subjected to automatic dishwashing using the composition of the invention the surface is hydrophilised. A surface is considered hydrophilic when water spreads evenly as opposite to bead into tiny droplets. Water spreads evenly having a sheeting effect that contributes to the shine of the surface when the surface dries.

The surface-modification surface-substantive polymers are water-soluble or water-dispersible copolymers including, in the form of polymerized units, (1) at least one amine-functional monomer, (2) at least one hydrophilic monomer with an acidic nature and (3) optionally at least one hydrophilic monomer with ethylenic unsaturation and with a neutral charge. Preferred copolymers include quaternized ammonium acrylamide acid copolymers.

One example of a surface-modification surface-substantive polymer useful in the present invention includes a water-soluble or water-dispersible copolymer comprising, in the form of polymerized units:

(a) at least one monomer compound of general formula I

Formula I

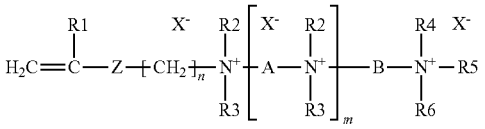

in which

R1 is a hydrogen atom or a methyl or ethyl group;

R2, R3, R4, R5 and R6, which are identical or different, are linear or branched C1-C6, preferably C1-C4, alkyl, hydroxyalkyl or aminoalkyl groups;

m is an integer from 0 to 10, preferably from 0 to 2;

n is an integer from 1 to 6, preferably 2 to 4;

Z represents a —C(O)O— or —C(O)NH— group or an oxygen atom;

A represents a (CH2)p group, p being an integer from 1 to 6, preferably from 2 to 4;

B represents a linear or branched C2-C12, advantageously C3-C6, polymethylene chain optionally interrupted by one or more heteroatoms or heterogroups, in particular O or NH, and optionally substituted by one or more hydroxyl or amino groups, preferably hydroxyl groups;

X, which are identical or different, represent counterions;

(b) at least one hydrophilic monomer carrying a functional group with an acidic nature which is copolymerizable with (a) and which is capable of being ionized in the wash solution;

(c) optionally at least one monomer compound with ethylenic unsaturation with a neutral charge which is copolymerizable with (a) and (b), preferably a hydrophilic monomer compound with ethylenic unsaturation with a neutral charge, carrying one or more hydrophilic groups, which is copolymerizable with (a) and (b).

Another example includes a water-soluble or water-dispersible copolymer comprising, in the form of polymerized units:

(a) at least one monomer compound of general formula II:

Formula II

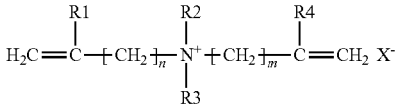

in which:

R1 and R4, independently of each other, represent a hydrogen atom or a linear or branched C1-C6 alkyl group;

R2 and R3, independently of each other, represent an alkyl, hydroxyalkyl or aminoalkyl group in which the alkyl group is a linear or branched C1-C6 chain, preferably a methyl group;

n and m are integers between 1 and 3;

X, which may be identical or different, represent counterions which are compatible with the water-soluble or water-dispersible nature of the polymer;

(b) at least one hydrophilic monomer bearing a function of acidic nature which is copolymerizable with (a) and capable of ionizing in the application medium, (c) optionally, at least one hydrophilic monomer compound containing ethylenic unsaturation and of neutral charge, hearing one or more hydrophilic groups, which is copolymerizable with (a) and (b), in which the a/b molar ratio is between 60/40 and 5/95, to give a hard surface hydrophilic properties.

Preferably, R1 represents hydrogen, R2 represents methyl, R3 represents methyl, R4 represents hydrogen, and m and n are equal to 1. The ion X— is advantageously chosen from halogen, sulfate, hydrogen sulfate, phosphate, citrate, formate and acetate.

The copolymer has a molecular mass of at least 1000, at least 10,000; it can be up to 20,000,000, or up to 10,000,000.

Another example is a water-soluble or water-dispersible copolymer comprising, in the form of polymerized units:

(a) at least one monomeric compound of general formula III:

Formula III

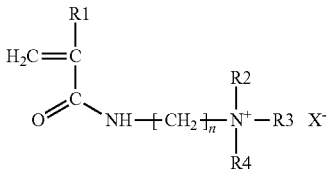

in which

R1 is a hydrogen atom or a methyl group, preferably a methyl group;

R2, R3 and R4 are linear or branched C1-C4 alkyl groups;

n represents an integer from 1 to 4, in particular the number 3;

X represents a counterion which is compatible with the water-soluble or water-dispersible nature of the polymer;

(b) at least one hydrophilic monomer chosen from C3-C8 carboxylic acids containing monoethylenic unsaturation, anhydrides thereof and water-soluble salts thereof;

(c) optionally at least one hydrophilic monomeric compound containing ethylenic unsaturation, of neutral charge, bearing one or more hydrophilic groups, which is copolymerizable with (a) and (b)

The average charge Q on the copolymer is defined by the equation:

$$Q = \frac{[a] - [b]\Gamma}{[a]}$$

In which [a] represents the molar concentration of monomer (a); and [b] represents the molar concentration of monomer (b) and Γ represents the rate of neutralization of monomers [b] defined by:

$$\Gamma = \frac{[COO^-]}{[COOH] + [COO^-]}$$

In which [COO—] and [COOH] represent respectively, the molar concentrations of monomers (b) in carboxylate and carboxylic acid form at the pH at which the ADW detergent is used being greater than 0 and possibly going down to 0.4 or even 0.2. The molar ratio (a)/(b) is advantageously between 25/75 and 70/30. The molar ratio c/(a+b+c) is advantageously between 0 and 40/100, preferably between 10/100 and 30/100. This copolymer is preferably a random copolymer.

The average charge Q on the said copolymer at the pH of the cleaning composition may be determined by any known means, in particular by assay using a polyvinyl sulphate solution or by zetametry.

The copolymer has a weight-average molecular mass of at least 1000, of at least 10,000; it can be up to 20,000,000, or up to 10,000,000.

Among the preferred monomers (a) are (meth)acrylamidopropyltrimethylammonium chloride (MAPTAC) and diallyldimethylammonium chloride (DADMAC). Among the preferred monomers (b) which may be mentioned are acrylic acid, methacrylic acid, α-ethacrylic acid, β,β,-dimethylacrylic acid, methylene-malonic acid, vinylacetic acid, allylacetic acid, ethylidineacetic acid, propylidineacetic acid, crotonic acid, maleic acid, fumaric acid, itaconic acid, citraconic acid, mesaconic acid, N-methacroylalanine, N-acryloylhydroxyglycine, and anhydrides and alkali metal salts and ammonium salts thereof. Among the monomers (c) which may be mentioned are acrylamide, vinyl alcohol, C1-C4 alkyl esters of acrylic acid and of methacrylic acid, C1-C4 hydroxyalkyl esters of acrylic acid and of methacrylic acid, in particular ethylene glycol and propylene glycol acrylate and methacrylate, polyalkoxylated esters of acrylic acid and of methacrylic acid, in particular the polyethylene glycol and polypropylene glycol esters, as well as polyols derived from starches and celluloses.

The monomer (a) content is preferably between 5 mol % and 60 mol %, preferably 20 mol % to 50 mol %.

The monomer (b) content is preferably between 10 mol % and 95 mol %, preferably 20 mol % to 80 mol %.

The monomer (c) content is preferably between 0 mol % and 50 mol %, preferably 5 mol % to 30 mol %.

The a/b molar ratio is preferably between 50/50 and 10/90.

A preferred surface-modification surface-substantive polymer for use herein is:

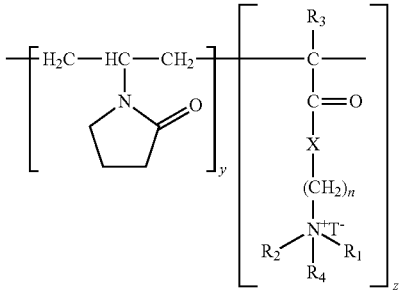

wherein

R1, R2, R3, R4 are independently selected from H or CH3 and not all can be H at the same time, when R1 is H, R2 and R4 are CH3 when R2 is H, R1 and R4 are CH3 when R4 is H, R2, and R1 are CH3

X is —O— or —NH—

T=Cl; Br; I; hydrogensulfate or methosulfate, ethylsulfate n=2-6 and the molecular weight of the polymer is from 60,000 to 1,500,000 dalton

Another surface-modification surface-substantive polymer is a polymer comprising a monomer that carries a chemical functionality selected from the group consisting of betaines and sulfobetaines. Preferably, such polymers further comprise a vinyl-pyrrolidone monomer or derivatives thereof.

Suitable polymers are commercially available:

POLYQUART ECOCLEAN, a modified corn starch with acrylic acid and acrylamidopropyltrimethylammonium chloride; by Cognis (BASF SE, Monheim, Germany);

MIRAPOL SURF S-210, comprising a copolymer of diallyl dimethyl ammonium acrylamide acrylic acid, Mirapol SURF-S 500, Mirapol SURF-S 310 and other hydrophilising polymers of the Mirapol SURF-S series, by Rhodia, SA.

MERQUAT 3330, comprising a combination of acrylic acid and dimethyldiallylammonium chloride and acrylamide; MERQUAT 280 and MERQUAT 295, comprising a combination of acrylic acid and diallyldimethylammonium chloride;

MERQUAT 2001, comprising a combination of acrylic acid, methacrylamido propyl trimethyl ammonium chloride, and methyl methacrylate; (Nalco Co., Naperville, Ill.).

A composition described herein is optionally prepared using MASURF SP-925 (Mason Chemical Company, Arlington Heights, Ill.), an ampholytic polymer formed from ethanaminium, N,N,N-trimethyl-2-[(2-methyl-1-oxo-2-propen-1-yl)oxy]-, chloride, 2-propenamide and 2-propenoic acid, and which is also a component in Masurf SP-1020. Other preferred surface-modification surface-substantive polymers include Sorez HS-205, Gafquat HS-100, Copolymer 845, Copolymer 958 and Gafquat 734 supplied by Ashland Chemicals.

Combinations of surface-modification, surface-substantive polymers are also useful herein.

Dispersant Polymer

The dispersant polymer is preferably used in any suitable amount from about 0.1 to about 20%, preferably from 0.2 to about 15%, more preferably from 0.3 to % by weight of the composition.

The dispersant polymer is a calcium dispersant polymer and it is capable to suspend calcium or calcium carbonate in an automatic dishwashing process.

The dispersant polymer has a calcium binding capacity within the range between 30 to 250 mg of Ca/g of dispersant polymer, preferably between 35 to 200 mg of Ca/g of dispersant polymer, more preferably 40 to 150 mg of Ca/g of dispersant polymer at 25° C. In order to determine if a polymer is a dispersant polymer within the meaning of the invention, the following calcium binding-capacity determination is conducted in accordance with the following instructions:

Calcium Binding Capacity Test Method

The calcium binding capacity referred to herein is determined via titration using a pH/ion meter, such as the Meettler Toledo SevenMulti™ bench top meter and a PerfectION™ comb Ca combination electrode. To measure the binding capacity a heating and stirring device suitable for beakers or tergotometer pots is set to 25° C., and the ion electrode with meter are calibrated according to the manufacturer's instructions. The standard concentrations for the electrode calibration should bracket the test concentration and should be measured at 25° C. A stock solution of 1000 mg/g of Ca is prepared by adding 3.67 g of $CaCl_2$-$2H_2O$ into 1 L of deionized water, then dilutions are carried out to prepare three working solutions of 100 mL each, respectively comprising 100 mg/g, 10 mg/g, and 1 mg/g concentrations of Calcium. The 100 mg Ca/g working solution is used as the initial concentration during the titration, which is conducted at 25° C. The ionic strength of each working solution is adjusted by adding 2.5 g/L of NaCl to each. The 100 mL of 100 mg Ca/g working solution is heated and stirred until it reaches 25° C. The initial reading of Calcium ion concentration is conducted at when the solution reaches 25° C. using the ion electrode. Then the test polymer is added incrementally to the calcium working solution (at 0.01 g/L intervals) and measured after 5 minutes of agitation following each incremental addition. The titration is stopped when the solution reaches 1 mg/g of Calcium. The titration procedure is repeated using the remaining two calcium concentration working solutions. The binding capacity of the test polymer is calculated as the linear slope of the calcium concentrations measured against the grams/L of test polymer that was added.

The dispersant polymer preferably bears a negative net charge when dissolved in an aqueous solution with a pH greater than 6.

The dispersant polymer can bear also sulfonated carboxylic esters or amides, in order to increase the negative charge at lower pH and improve their dispersing properties in hard water. The preferred dispersant polymers are sulfonated polymers, i.e., polymer comprising sulfonated monomers.

Preferably, the dispersant polymers are sulfonated derivatives of polycarboxylic acids and may comprise two, three, four or more different monomer units. The preferred copolymers contain:

At least one structural unit derived from a carboxylic acid monomer having the general formula (III):

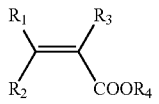

(III)

wherein $R_1$ to $R_3$ are independently selected from hydrogen, methyl, linear or branched saturated alkyl groups having from 2 to 12 carbon atoms, linear or branched mono or polyunsaturated alkenyl groups having from 2 to 12 carbon atoms, alkyl or alkenyl groups as aforementioned substituted with —NH2 or —OH, or —COOH, or $COOR_4$, where $R_4$ is selected from hydrogen, alkali metal, or a linear or branched, saturated or unsaturated alkyl or alkenyl group with 2 to 12 carbons;

Preferred carboxylic acid monomers include one or more of the following: acrylic acid, maleic acid, maleic anhydride, itaconic acid, citraconic acid, 2-phenylacrylic acid, cinnamic acid, crotonic acid, fumaric acid, methacrylic acid, 2-ethylacrylic acid, methylenemalonic acid, or sorbic acid. Acrylic and methacrylic acids being more preferred.

Optionally, one or more structural units derived from at least one nonionic monomer having the general formula (IV):

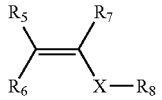

(IV)

Wherein $R_5$ to $R_7$ are independently selected from hydrogen, methyl, phenyl or hydroxyalkyl groups containing 1 to 6 carbon atoms, and can be part of a cyclic structure, X is an optionally present spacer group which is selected from —$CH_2$—, —COO—, —CONH— or —$CONR_8$—, and $R_8$ is selected from linear or branched, saturated alkyl radicals having 1 to 22 carbon atoms or unsaturated, preferably aromatic, radicals having from 6 to 22 carbon atoms.

Preferred non-ionic monomers include one or more of the following: butene, isobutene, pentene, 2-methylpent-1-ene, 3-methylpent-1-ene, 2,4,4-trimethylpent-1-ene, 2,4,4-trimethylpent-2-ene, cyclopentene, methylcyclopentene, 2-methyl-3-methyl-cyclopentene, hexene, 2,3-dimethylhex-1-ene, 2,4-dimethylhex-1-ene, 2,5-dimethylhex-1-ene, 3,5-dimethylhex-1-ene, 4,4-dimethylhex-1-ene, cyclohexene, methylcyclohexene, cycloheptene, alpha olefins having 10 or more carbon atoms such as, dec-1-ene, dodec-1-ene, hexadec-1-ene, octadec-1-ene and docos-1-ene, preferred aromatic monomers are styrene, alpha methylstyrene, 3-methylstyrene, 4-dodecylstyrene, 2-ethyl-4-bezylstyrene, 4-cyclohexylstyrene, 4-propylstyrol, 1-vinylnaphtalene, 2-vinylnaphtalene; preferred carboxylic ester monomers are methyl (meth)acrylate, ethyl (meth)acrylate, propyl (meth) acrylate, t-butyl (meth)acrylate, pentyl (meth)acrylate, hexyl (meth)acrylate, 2-ethylhexyl (meth)acrylate, octyl (meth) acrylate, lauryl (meth)acrylate, stearyl (meth)acrylate and behenyl (meth)acrylate; preferred amides are N-methyl acrylamide, N-ethyl acrylamide, N-t-butyl acrylamide, N-2-ethylhexyl acrylamide, N-octyl acrylamide, N-lauryl acrylamide, N-stearyl acrylamide, N-behenyl acrylamide.

and at least one structural unit derived from at least one sulfonic acid monomer having the general formula (V) and (VI):

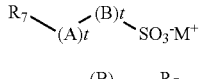

(V)

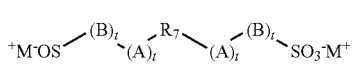

(VI)

wherein $R_7$ is a group comprising at least one sp2 bond, A is O, N, P, S, an amido or ester linkage, B is a mono- or polycyclic aromatic group or an aliphatic group, each t is independently 0 or 1, and M+ is a cation. In one aspect, $R_7$ is a C2 to C6 alkene. In another aspect, R7 is ethene, butene or propene.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfopropylmethacrylate, sulfomethacrylamide, sulfomethylmethacrylamide and mixtures of said acids or their water-soluble salts.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is preferably (meth)acrylic acid. The sulfonic acid monomer is preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

Suitable dispersant polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, preferably from about 5,000 to about 45,000 g/mol. The dispersant polymer may be a low molecular weight homopolymer of polyacrylate, with an average molecular weight of from 1,000 to 20,000, particularly from 2,000 to 10,000, and particularly preferably from 3,000 to 5,000.

The dispersant polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000 and more preferably from 20,000 to 50,000 and in particular 30,000 to 40,000 g/mol. and a ratio of (meth)acrylate to maleate or fumarate segments of from 30:1 to 1:2.

The dispersant polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such dispersant polymer may have a molecular weight of from 4,000 to 20,000 and an acrylamide content of from 0% to 15%, by weight of the polymer.

Dispersant polymers suitable herein also include itaconic acid homopolymers and copolymers.

Alternatively, the dispersant polymer can be selected from the group consisting of alkoxylated polyalkyleneimines, alkoxylated polycarboxylates, polyethylene glycols, styrene co-polymers, cellulose sulfate esters, carboxylated polysaccharides, amphiphilic graft copolymers and mixtures thereof.

Automatic Dishwashing Cleaning Composition

The automatic dishwashing cleaning composition can be in any physical form. It can be a loose powder, a gel or presented in unit dose form. Preferably it is in unit dose form, unit dose forms include pressed tablets and water-soluble packs. The automatic dishwashing cleaning composition of the invention is preferably presented in unit-dose form and it can be in any physical form including solid, liquid and gel form. The composition of the invention is very well suited to be presented in the form of a multi-compartment pack, more in particular a multi-compartment pack comprising compartments with compositions in different physical forms, for example a compartment comprising a composition in solid form and another compartment comprising a composition in liquid form. The composition is preferably enveloped by a water-soluble film such as polyvinyl alcohol. Especially preferred are compositions in unit dose form wrapped in a polyvinyl alcohol film having a thickness of less than 100 μm. The detergent composition of the invention weighs from about 8 to about 25 grams, preferably from about 10 to about 20 grams. This weight range fits comfortably in a dishwasher dispenser. Even though this range amounts to a low amount of detergent, the detergent has been formulated in a way that provides all the benefits mentioned herein above.

The composition is preferably phosphate free. By "phosphate-free" is herein understood that the composition comprises less than 1%, preferably less than 0.1% by weight of the composition of phosphate.

Excellent cleaning and shine benefits are obtained with compositions comprising the surface-modification surface-substantive polymer and dispersant polymers of the invention and a complexing agent. For the purpose of this invention a "complexing agent" is a compound capable of binding polyvalent ions such as calcium, magnesium, lead, copper, zinc, cadmium, mercury, manganese, iron, aluminium and other cationic polyvalent ions to form a water-soluble complex. The complexing agent has a logarithmic stability constant ([log K]) for Ca2+ of at least 5, preferably at least 6. The stability constant, log K, is measured in a solution of ionic strength of 0.1, at a temperature of 25° C.

Preferably, the composition of the invention comprises an amino-carboxylated complexing agent, preferably selected from the group consisting of methyl-glycine-diacetic acid (MGDA), its salts and derivatives thereof, glutamic-N,N-diacetic acid (GLDA), its salts and derivatives thereof, iminodisuccinic acid (IDS), its salts and derivatives thereof, carboxy methyl inulin, its salts and derivatives thereof and mixtures thereof. Especially preferred complexing agent for use herein is selected from the group consisting of MGDA and salts thereof, especially preferred for use herein is the three sodium salt of MGDA. Preferably, the complexing agent is the three sodium salt of MGDA and the dispersant polymer is a sulfonated polymer, more preferably comprising 2-acrylamido-2-methylpropane sulfonic acid monomer.

Bleach

The composition of the invention preferably comprises from about 1 to about 20%, more preferably from about 5 to about 18%, even more preferably from about 8 to about 15% of bleach by weight of the composition.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially dodecanediperoxoic acid, tetradecanediperoxoic acid, and hexadecanediperoxoic acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5, preferably from 0.2 to 2% by weight of the composition of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the composition. Preferably the bleach catalyst is a manganese bleach catalyst.

Inorganic Builder

The composition of the invention preferably comprises an inorganic builder. Suitable inorganic builders are selected from the group consisting of carbonate, silicate and mixtures thereof. Especially preferred for use herein is sodium carbonate. Preferably the composition of the invention comprises from 5 to 50%, more preferably from 10 to 40% and especially from 15 to 30% of sodium carbonate by weight of the composition.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement.

The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, S130A, Y167A, R170S, A194P, V205I and/or M222S.

Most preferably the protease is selected from the group comprising the below mutations (BPN' numbering system) versus either the PB92 wild-type (as disclosed in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+S130A (iii) N76D+N87R+G118R+S128L+P129Q+S130A+S188D+N248R (iv) N76D+N87R+G118R+S128L+P129Q+S130A+S188D+V244R (v) N76D+N87R+G118R+S128L+P129Q+S130A (vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 7 and especially from about 1 to about 6 mg of active protease.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as in WO 06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (as disclosed in U.S. Pat. No. 6,093,562), especially those comprising one or more of the following mutations M202, M208, 5255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 5%, more preferably from 0.05 to 3% and especially from 0.5 to 2% of a crystal growth inhibitor by weight of the product, preferably HEDP.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.1 to 5%, more preferably from 0.2 to 4% and specially from 0.3 to 3% by weight of the composition of a metal care agent, preferably the glass care agent is a zinc containing material, specially hydrozincite.

The automatic dishwashing composition of the invention preferably has a pH as measured in 1% weight/volume aqueous solution in distilled water at 20° C. of from about 9 to about 12, more preferably from about 10 to less than about 11.5 and especially from about 10.5 to about 11.5.

The automatic dishwashing composition of the invention preferably has a reserve alkalinity of from about 10 to about 20, more preferably from about 12 to about 18 at a pH of 9.5 as measured in NaOH with 100 grams of product at 20° C.

EXAMPLES

Example 1. Multicycle Spotting Test

In order to illustrate the anti-spotting benefits of the compositions of the invention, four ADW detergents were prepared. The compositions were made into superposed dual-compartment water-soluble pouches. One compartment contained the powder composition and the other compartment the liquid composition.

| Active material | Composition A Comparative | Composition B Invention | Composition C Invention |
|---|---|---|---|
| Powder compartement | | | |
| Sodium carbonate | 3.81 g | 3.81 g | 3.81 g |
| MGDA | 3.34 g | 3.34 g | 3.34 g |
| Percarbonate | 2.60 g | 2.60 g | 2.60 g |
| Dispersing polymer | 1.76 g | 1.26 g | 1.26 g |
| Sodium sulphate | 1.15 g | 1.15 g | 1.15 g |
| TAED | 0.22 g | 0.22 g | 0.22 g |
| Bleach catalyst | 1 mg | 1 mg | 1 mg |

-continued

| Active material | Composition A Comparative | Composition B Invention | Composition C Invention |
|---|---|---|---|
| Stainzyme Plus | 3 mg | 3 mg | 3 mg |
| Ultimase | 11 mg | 11 mg | 11 mg |
| HEDP | 0.10 g | 0.10 g | 0.10 g |
| Surface modification polymer 1 | — | 0.50 g | |
| Surface modification polymer 2 | | 0.50 g | |
| Liquid compartment | | | |
| Nonionic surfactant 1 | 0.7 g | 0.7 g | 0.7 g |
| Nonionic surfactant 2 | 0.9 g | 0.9 g | 0.9 g |
| Dipropylene glycol | 0.4 g | 0.4 g | 0.4 g |
| Film | | | |
| Poly vinyl alcohol | 0.6 g | 0.6 g | 0.6 g |

MGDA trisodium salt of methylglycinediacetic acid, supplied by BASF

Bleach catalyst MnTACN, supplied by Clairant.

HEDP 1-hydroxyethane 1,1-diphosphonic acid

Nonionic surfactant 1 Plurafac SLF 180, supplied by BASF.

Nonionic surfactant 2 Lutensol TO7, supplied by BASF.

Surface Modification Polymer 1 Amphoteric modified starch, Polyquart Ecoclean supplied by BASF Surface Modification Polymer 2 ampholytic polymer, Masurf SP925 supplied by Mason Chemical Co.

Dispersant Polymer sulphonated copolymer supplied as Acusol 588 supplied by Dow.

Six new tumbler-style drinking glasses (such as Libbey® part number 158LIB Heavy Base 20 Oz. Ice Tea Glass Tumbler, from Libbey Inc, Toledo, Ohio, U.S.A.) were conditioned by washing them with a phosphate-free automatic dishwashing cleaning composition, (dishwashing cleaning composition specified herein as Composition A of Example 1), and then washed again with 20 g of food-grade citric acid powder. Both washes were carried out using a Miele GSL dishwashing machine (Miele Co. Ltd, Oxon, U.K.), in a normal wash 50° C. program, with soft water (3 US gpg).

The multicycle filming test was carried out using a Miele GSL dishwashing machine (Miele Co. Ltd, Oxon, U.K.), in a normal wash 50° C. setting. On each cycle two pots containing 50 g of frozen ATS soil (as detailed herein before) were added into the washing machine at the start of the wash at the same time as the detergent compositions. The inlet water had a hardness of 20 US gpg. The dishwashing load included stainless steel pots in addition to the glasses.

Spot Count and Stainless Steel Grading

After running 5 consecutives cycles at the specified conditions, the glasses were then photographed in a photographic booth with controlled light and constant settings against a black background. The resulting images were analyzed using computer aided software to count spots on the glasses.

The photographs were taken in black and white and the gray scale of each pixel is calculated from 0 to 255, where 0 is completely black and 255 is completely white.

The photograph size is measured in pixels; a typical photograph contains 1944×2592 pixels, equivalent to about 5 million pixels. An area is selected on the glass surface, eliminating the edges and bottom of the glass, where the light intensity is increased, this area is the analyzable area. Spots appear whiter vs. the rest of the background and for them to be counted they need to be 4 gray scales higher vs. the background. A spot is defined as a circular cluster larger than 4 pixels with higher gray scale (4 units) vs. the background.

The stainless steel pans were also visually evaluated after the four cycles.

Results

| Active material | Composition A Comparative | Compositions B Invention | Compositions C Invention |
|---|---|---|---|
| Spot count | 97 | 12 | 11 |
| Grit count | 210 | 36 | 62 |

As it can be seen the amount of spots is reduced when compositions according to the invention are used, showing less spots and better stainless steel care after 5 wash cycles.

Example 2. Contact Angle Measurements

To evaluate the contact angle of the glass after being treated with the ADW detergents of the invention, the following compositions where prepared.

| Active material | Composition D Comparative | Composition E Invention | Composition F Invention |
|---|---|---|---|
| Powder compartement | | | |
| MGDA | 5.76 g | 5.76 g | 5.76 g |
| Sodium carbonate | 3.01 g | 3.01 g | 3.01 g |
| Percarbonate | 2.75 g | 2.75 g | 2.75 g |
| Dispersing polymer | 0.88 g | 0.38 g | 0.38 g |
| HEDP | 0.10 g | 0.10 g | 0.10 g |
| Bleach catalyst | 4 mg | 4 mg | 4 mg |
| Stainzyme Plus | 4 mg | 4 mg | 4 mg |
| Ultimase | 34 mg | 34 mg | 34 mg |
| Surface modification polymer 1 | — | 0.50 g | |
| Surface modification polymer 2 | | | 0.50 g |
| Liquid compartment | | | |
| Nonionic surfactant 1 | 0.75 g | 0.7 g | 0.7 g |
| Nonionic surfactant 2 | 0.90 g | 0.9 g | 0.9 g |
| Dipropylene glycol | 0.39 g | 0.4 g | 0.4 g |
| Film | | | |
| Poly vinyl alcohol | 0.6 g | 0.6 g | 0.6 g |

MGDA trisodium salt of methylglycinediacetic acid, supplied by BASF

HEDP 1-hydroxyethane 1,1-diphosphonic acid

Nonionic surfactant 1 Plurafac SLF 180, supplied by BASF.

Nonionic surfactant 2 Lutensol TO7, supplied by BASF.

Surface Modification Polymer 1 Amphoteric modified starch, Polyqurt Ecoclean supplied by BASF Surface Modification Polymer 2 ampholytic polymer, Masurf SP925 supplied by Mason Chemical Co.

Dispersant Polymer sulphonated copolymer supplied as Acusol 588 supplied by Dow.

Four new tumbler-style drinking glasses (such as Libbey® part number 158LIB Heavy Base 20 Oz. Ice Tea Glass Tumbler, from Libbey Inc, Toledo, Ohio, U.S.A.) were conditioned by washing them with a phosphate-free automatic dishwashing cleaning composition, (dishwashing cleaning composition specified herein as Composition A of Example 1), and then washed again with 20 g of food-grade citric acid powder. Both washes were carried out using a Miele GSL dishwashing machine (Miele Co. Ltd, Oxon, U.K.), in a normal wash 50° C. program, with soft water (3 US gpg).

Contact Angle Measurements

The contact angle of deionized water on glasses washed in a dishwasher with the automatic dishwashing composition of the invention in the presence of soil was measured in accordance with the following protocol.

After being conditioned, the glasses were washed with the compositions of the invention by placing the four glasses on the top rack of the dishwasher, and placing two plastic pots containing 50 g of ATS frozen soil (as detailed hereinabove) into a Miele GSL dishwashing machine (Miele Co. Ltd, Oxon, U.K), at the start of the main wash, at the same time as the cleaning composition. A normal wash 50° C. program was carried out with hard water (20 US gpg). The glasses were removed at the end of the full wash cycle and the contact angle of deionized water was measured promptly and with great care taken to prevent contamination of the outer surface of the glass.

The contact angle measurements were conducted using a Krüss MobileDrop instrument (MobileDrop model GH11, from Krüss GmbH, Hamburg, Germany), and the accompanying software (Drop Shape Analysis 2 software). The measurements were run using deionized water at 20° C. Six measurements were made on the outside of each individual glass, with the six drops being distributed evenly around the circumference of the glass. Both sides of each drop's image were measured and averaged, and the total average value measured for all drops is reported.

Results

| Composition | Composition D Comparative | Composition E Invention | Composition F Invention |
|---|---|---|---|
| Contact angle | 54.1 | 44.3 | 34.6 |
| Std. Dev | 1.9 | 5.2 | 2.9 |

For the previous results it is possible to see that the contact angles is reduced when the glasses are treated with the compositions of the invention.

Example 3. Drainage Profile

In order to assess whether a polymer is a surface-modification surface-substantive (SMSS) polymer within the meaning of the invention, the following test was conducted: A conditioned drinking glass (washed in an automatic dishwasher in soft water at 50° C. with a phosphate-free cleaning composition, and then washed again with 20 g of food-grade citric acid powder, as detailed herein in the contact angle measurement test method instructions section), is immersed in a solution comprising 0.5 g of test polymer in 5 L of deionized water for 20 mins. The wet glass is then placed inverted (i.e., upside down) on a support rack and rinsed with dyed water. The dyed water is comprised of 6000 mL of deionized water dyed with 8 mL of sanolin blue liquid dye EHRL (Clariant International Ltd, Muttenz, Switzerland). 100 mL of dyed water is squirted onto the outside wall of the inverted glass with a syringe having an outlet of 2 mm diameter. The flow behaviour of the dyed water is visually observed. The test polymer is considered to be a surface-modification surface-substantive polymer if the dyed water is observed to sheet and spread across the surface while draining, as opposed to creating droplets while draining.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited.

The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An automatic dishwashing cleaning composition comprising a dispersant polymer and a surface-modification surface-substantive polymer wherein the dispersant polymer is a sulfonated polymer and wherein the surface-modification surface-substantive polymer is selected from the group consisting of:

i) a quaternized ammonium acrylamide acrylic acid copolymer;

ii) a polymer of modified corn starch with acrylic acid and acrylamidopropyltrimethylammonium chloride iii) a polymer formed from ethanaminium, N,N,N-trimethyl-2-[(2-methyl-1-oxo-2-propen-1-yl)oxyl-, chloride, 2-propenamide and 2-propenoic acid;

iv) a polymer comprising a monomer that carries a chemical functionality selected from the group consisting of betaines and sulfobetaines;

v) a polymer having the following formula

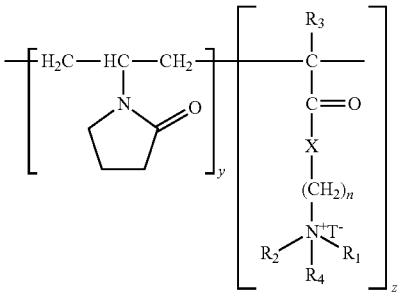

wherein $R_1$, $R_2$, $R_3$, $R_4$ are independently selected from H or $CH_3$ and not all can be H at the same time, when $R_1$ is H, $R_2$ and $R_4$ are $CH_3$ when $R_2$ is H, $R_1$ and $R_4$ are $CH_3$ when $R_4$ is H, $R_2$, and $R_1$ are $CH_3$ X is —O— or —NH—

T=Cl; Br; I; hydrogensulfate or methosulfate; ethylsulfate n=2-6 and the molecular weight of the polymer is from about 60,000 to about 1,500,000 dalton; and vi) mixtures thereof, wherein the surface-modification surface-substantive polymer is a polymer formed from ethanaminium, N,N,N-trimethyl-2-[(2-methyl-1-oxo-2-propen-1-yl) oxy]-, chloride, 2-propenamide and 2-propenoic acid.

2. A composition according to claim 1 wherein the surface-modification surface-substantive polymer is a cationic polymer and wherein the cationic polymer is a quaternized ammonium acrylamide acrylic acid copolymer.

3. A composition according to claim 1 wherein the surface-modification surface-substantive polymer is a polymer of modified corn starch with acrylic acid and acrylamidopropyltrimethylammonium chloride.

4. A composition according to claim 1 wherein the surface-modification surface-substantive polymer has the following formula

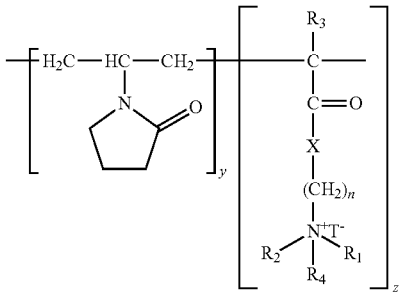

wherein $R_1$, $R_2$, $R_3$, $R_4$ are independently selected from H or $CH_3$ and not all can be H at the same time, when $R_1$ is H, $R_2$ and $R_4$ are $CH_3$ when $R_2$ is H, $R_1$ and $R_4$ are $CH_3$ when $R_4$ is H, $R_2$, and $R_1$ are $CH_3$ X is —O— or —NH—

T=Cl; Br; I; hydrogensulfate or methosulfate; ethylsulfate n=2-6 and the molecular weight of the polymer is from about 60,000 to about 1,500,000 dalton.

5. A composition according to claim 1 wherein the surface-modification surface-substantive polymer is a polymer comprising a monomer that carries a chemical functionality selected from the group consisting of betaines and sulfobetaines.

6. A composition according to claim 1 wherein the surface-modification surface-substantive polymer is a polymer comprising a monomer that carries a chemical functionality selected from the group consisting of betaines and sulfobetaines and wherein the surface-modification surface-substantive polymer also comprises a vinyl-pyrrolidone monomer or derivatives thereof.

7. A composition according to claim 1 wherein the composition comprises from about 0.01% to about 10% by weight of the cleaning composition, of the surface-modification surface-substantive polymer.

8. A composition according to claim 1 wherein the composition is phosphate free.

9. A composition according to claim 1 comprising a complexing agent selected from the group consisting of methyl glycine diacetic acid, its salts and derivatives thereof, glutamic-N,N-diacetic acid, its salts and derivatives thereof, iminodisuccinic acid, its salts and derivatives thereof, carboxy methyl inulin, its salts and derivatives thereof, and mixtures thereof.

10. A composition according to claim 1 comprising a complexing agent selected from the group consisting of methyl glycine diacetic acid, its salts and derivatives thereof.

11. A composition according to claim 1 wherein the composition comprises bleach and a manganese bleach catalyst.

12. A composition according to claim 1 wherein the composition is capable of leaving glass after being washed with the composition in an automatic dishwasher with a contact angle with deionised water of less than about 50° and wherein the surface-modification surface-substantive polymer has a sheeting forming effect on water drainage from glass.

13. A method of cleaning glassware during automatic dishwashing, the method comprising the following steps:

a) placing glassware into an automatic dishwasher;

b) providing an automatic dishwashing cleaning composition according to claim 1; and c) running the automatic dishwasher.

14. Use of a composition according to claim 1 for the reduction of spotting on glassware in automatic dishwashing.

15. An automatic dishwashing cleaning composition comprising a dispersant polymer and a surface-modification surface-substantive polymer wherein the dispersant polymer is a sulfonated polymer and wherein the surface-modification surface-substantive polymer is selected from the group consisting of:

i) a quaternized ammonium acrylamide acrylic acid copolymer;

ii) a polymer of modified corn starch with acrylic acid and acrylamidopropyltrimethylammonium chloride iii) a polymer formed from ethanaminium, N,N,N-trimethyl-2-[(2-methyl-1-oxo-2-propen-1-yl)oxyl-, chloride, 2-propenamide and 2-propenoic acid;

iv) a polymer comprising a monomer that carries a chemical functionality selected from the group consisting of betaines and sulfobetaines;

v) a polymer having the following formula

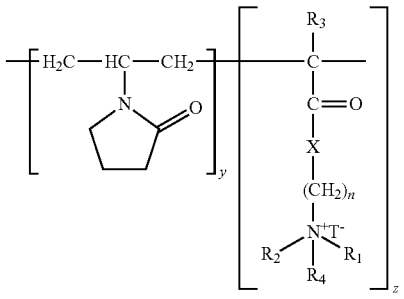

wherein $R_1$, $R_2$, $R_3$, $R_4$ are independently selected from H or $CH_3$ and not all can be H at the same time, when $R_1$ is H, $R_2$ and $R_4$ are $CH_3$ when $R_2$ is H, $R_1$ and $R_4$ are $CH_3$ when $R_4$ is H, $R_2$, and $R_1$ are $CH_3$ X is —O— or —NH—

T=Cl; Br; I; hydrogensulfate or methosulfate; ethylsulfate n=2-6 and the molecular weight of the polymer is from about 60,000 to about 1,500,000 dalton;

vi) a crystal growth inhibitor; and vii) mixtures thereof.

* * * * *